US011024116B1

(12) United States Patent
Hoehne

(10) Patent No.: US 11,024,116 B1
(45) Date of Patent: Jun. 1, 2021

(54) DYNAMIC AUTOMATED SOCIAL DISTANCING ON ELECTRONIC GAMING MACHINES

(71) Applicant: Table Trac, Inc., Minnetonka, MN (US)

(72) Inventor: Chad B. Hoehne, Minnetonka, MN (US)

(73) Assignee: TABLE TRAC, INC., Minnetonka, MN (US)

( * ) Notice: Subject to any disclaimer, the term of this patent is extended or adjusted under 35 U.S.C. 154(b) by 0 days.

(21) Appl. No.: 16/884,731

(22) Filed: May 27, 2020

Related U.S. Application Data

(60) Provisional application No. 63/020,154, filed on May 5, 2020.

(51) Int. Cl.
*G07F 17/32* (2006.01)

(52) U.S. Cl.
CPC ..... *G07F 17/3223* (2013.01); *G07F 17/3227* (2013.01); *G07F 17/3244* (2013.01)

(58) Field of Classification Search
CPC ..... G07F 17/3223; G07F 17/3227; G07F 17/3244
See application file for complete search history.

(56) References Cited

U.S. PATENT DOCUMENTS

| | | | | |
|---|---|---|---|---|
| 10,850,184 | B1 * | 12/2020 | Colvin | A63F 1/12 |
| 10,915,231 | B1 * | 2/2021 | Bacon | G06Q 10/02 |
| 2020/0334945 | A1 * | 10/2020 | Perea-OcHoa | A61L 2/24 |

OTHER PUBLICATIONS

Bohner, Tiana, "Las Vegas company creates tools for casinos to manage cleaning, social distancing", May 12, 2020, Fox-5 KWU-TV, https://www.fox5vegas.com/coronavirus/las-vegas-company-creates-tools-for-casinos-to-manage-cleaning-social-distancing/article_89bcbfda-94d0-11ea-bd84-0b91fd83f72a.html (Year: 2020).*

"Scientific Games unveils suite of innovative solutions to help operators reimagine today's casino floor," Yogonet Gaming News, May 27, 2020, 5 pages, URL: https://www.yogonet.com/international/noticias/2020/05/27/53373-scientific-games-unveils-suite-of-innovative-solutions-to-help-operators-reimagine-todays-casino-floor?utm_campaign=getresponse&utm_content=getresponse&utm_medium=getresponse&utm_source=getresponse&utm_term=getresponse.

"Win Systems launches PlaySafe by Wigos," Yogonet Gaming News, Jun. 5, 2020, 5 pages, URL: https://www.yogonet.com/international/noticias/2020/06/05/53468-win-systems-launches-playsafe-by-wigos.

Stutz, H., "Everi sees digital and cashless innovation as the focus of the post-pandemic casino world," CDC Gaming Reports Inc., Jun. 3, 2020, 3 pages, URL: https://www.cdcgamingreports.com/everi-sees-digital-and-cashless-innovation-as-the-focus-the-post-pandemic-casino-world/.

Szydelko, P., "Vegas firm is finding ways to make casinos a safer bet," Travel Weekly, Jul. 26, 2020, 4 pages, URL: https://www.travelweekly.com/North-America-Travel/Vegas-firm-is-finding-ways-to-make-casinos-a-safer-bet.

* cited by examiner

*Primary Examiner* — Corbett B Coburn
(74) *Attorney, Agent, or Firm* — Hamre, Schumann, Mueller & Larson, P.C.

(57) ABSTRACT

Dynamic, automatic establishment of social distancing on electronic gaming machines (EGMs). An electronic notice of a game play triggering event that takes place at a first EGM is sent to a control system, and in response to receiving the electronic notice, the control system automatically temporarily deactivates other EGMs that are within a first deactivation zone adjacent to the first EGM. Thereafter, at cessation of game play on the first EGM, the deactivated EGMs are reactivated by the control system. The first EGM may optionally be deactivated to allow the first EGM to be cleaned before the first EGM is activated and made available for additional game play.

25 Claims, 5 Drawing Sheets

DYNAMIC AUTOMATED SOCIAL DISTANCING ON ELECTRONIC GAMING MACHINES

FIELD

The technology described herein relates to gaming in casinos and other venues containing electronic gaming machines (hereinafter EGMs), and controlling operation of the EGMs to implement dynamic, automated social distancing on the EGMs.

BACKGROUND

In casino settings, EGMs such as electronic slot machines, video poker machines, video roulette machines, electronic bingo machines, and the like are typically arranged close together which means that game players simultaneously playing the EGMs are relatively close to one another. The closeness of the game players to one another while playing EGMs is problematic in certain situations, such as during a virus pandemic where experts recommend that a minimum distance be maintained between individuals, referred to as social distancing, to minimize spread of the virus.

SUMMARY

Systems and methods are described herein that relate to dynamic, automatic establishment of social distancing on EGMs. The techniques described herein can be implemented by a casino management system running on one or more control systems of the casino or other establishment containing the EGMs. The systems and methods described herein allow a casino or other establishment to provide a safe and socially responsible gaming experience for their patrons by dynamically and automatically creating social distancing zones around EGMs being played by patrons, and dynamically and automatically changing the social distancing zones as the EGMs being played change.

The EGMs can be located in casinos, racinos, gaming establishments, entertainment facilities, and other venues that permit game players to play EGMs. The systems and methods described herein can be used with any type of EGM. Examples of EGMs include, but are not limited to, electronic slot machines, video poker machines, video roulette machines, electronic bingo machines, electronic promotional games, electronic prize wheels, or the like. The EGMs may also be referred to as electronic casino games, casino games, electronic game machines, electronic games, and the like.

In one embodiment, a method of controlling electronic gaming machines in a casino includes sending electronic notice of a game play triggering event that takes place at a first EGM to a control system, and in response to receiving the electronic notice, the control system automatically temporarily deactivating other EGMs that are within a first deactivation zone adjacent to the first EGM. Thereafter, at cessation of game play on the first EGM, the deactivated EGMs are reactivated by the control system. In some embodiments, the first EGM may optionally be deactivated to allow the first EGM to be cleaned before the first EGM is activated and made available for additional game play.

In another embodiment, a method of controlling electronic gaming machines in a casino is described. The electronic gaming machines are in electronic communication with a control system which can be located within the casino or located remote from the casino. The method includes generating an electronic notice signal upon a game play triggering event that takes place at a first one of the electronic gaming machines, and sending the electronic notice signal to the control system. In response to receiving the electronic notice signal, the control system determines a first deactivation zone adjacent to the first electronic gaming machine, and the control system generates and sends a deactivation signal to electronic gaming machines that are within the first deactivation zone other than the first electronic gaming machine to temporarily deactivate the other electronic gaming machines within the first deactivation zone.

In another embodiment, at least one non-transitory computer-readable storage medium is described. The storage medium includes instructions stored thereon that, responsive to being executed with processor circuitry of a computer control system that includes the at least one non-transitory computer-readable storage medium, causes the computer control system to implement a method of controlling electronic gaming machines in a casino that are in communication with the computer control system. The method implemented by the computer control system includes receiving an electronic notice of a game play triggering event that takes place at a first one of the electronic gaming machines, and in response to receiving the electronic notice determining a first deactivation zone adjacent to the first electronic gaming machine, and generating and sending a deactivation signal to electronic gaming machines that are within the first deactivation zone other than the first electronic gaming machine to temporarily deactivate the other electronic gaming machines within the first deactivation zone.

DRAWINGS

DETAILED DESCRIPTION

The following is a description of systems and methods that relate to dynamic, automatic establishment of social distancing on EGMs. The systems and methods are implemented dynamically and automatically by the casino or other establishment responsible for managing the EGMs. In addition, the techniques described herein are dynamic and the social distancing zones can be dynamically and automatically changed as game players stop playing EGMs and/or want to initiate game play on different EGMs.

As used throughout the description and claims, the terms "game player", "person" and "user" may be used interchangeably to refer to an individual who wishes to initiate game play on an EGM and who is playing an EGM.

As used throughout the description and claims, the term electronic gaming machine or EGM includes, but is not limited to, electronic slot machines, video poker machines, video roulette machines, electronic bingo machines, electronic promotional games, electronic prize wheels, or the like. The electronic gaming machines may also be referred to as electronic casino games, casino games, electronic game machines, electronic games, and the like.

The EGMs can be located in any venue or facility referred to by a variety of names including a casino, racino, a gaming establishment, an entertainment center, and like facilities and venues. The term "casino" as used throughout the description and claims is intended to include and encompass all of these facilities and venues.

Figure 1:
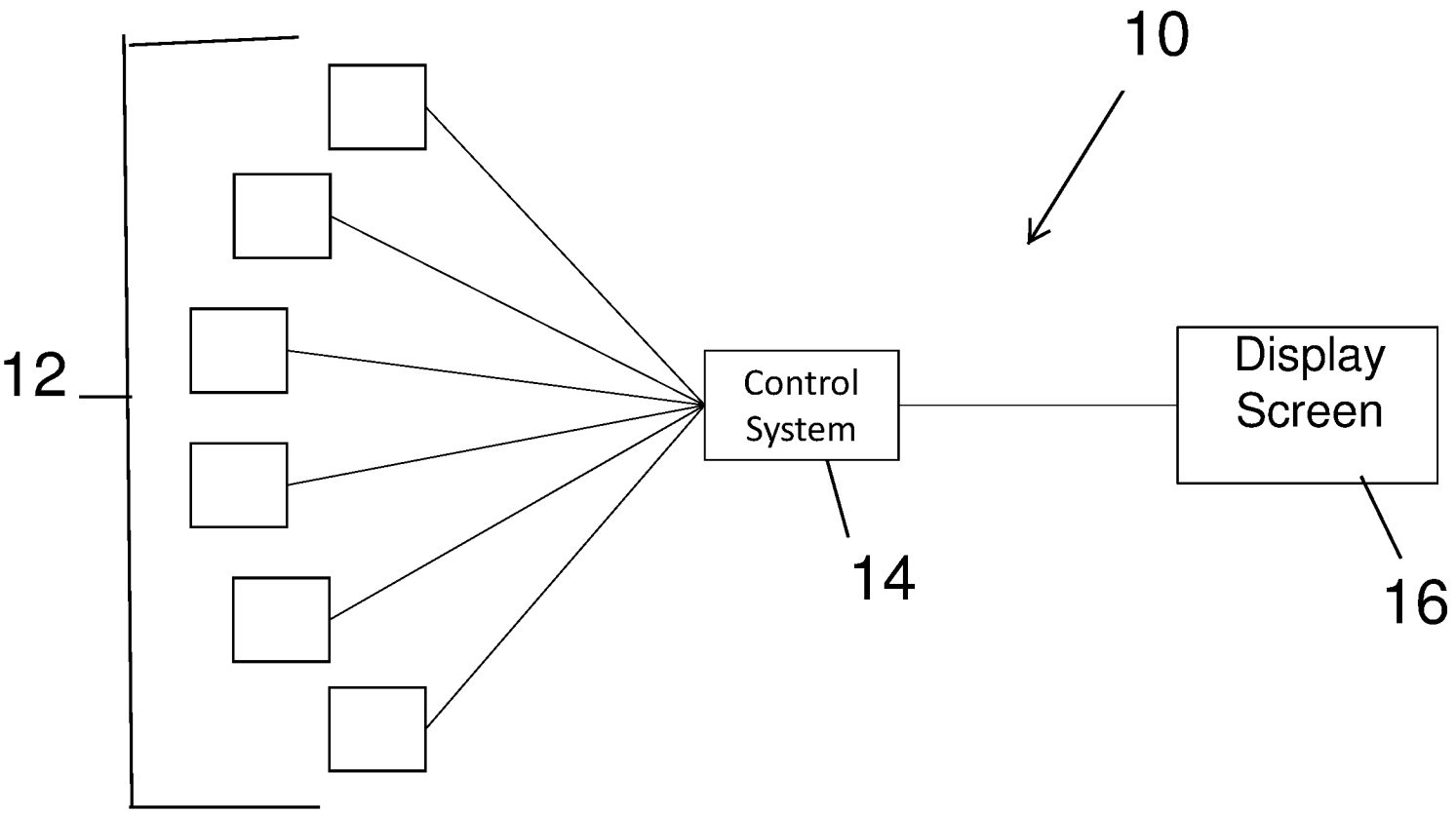
FIG. 1 illustrates an example of a system described herein.

Referring initially to FIG. 1, a system 10 is illustrated. The system 10 includes a plurality of electronic gaming machines (EGM) 12 and a control system 14 that is in electronic communication with each of the EGMs 12. The system 10 further includes one or more display screens 16 that are in communication with the control system 14. The EGMs 12 and the control system 14 are in two-way wired or wireless electronic communications with one another whereby the control system 14 can monitor each EGM 12 and can control the operation of each EGM 12. In addition, the control system 14 is in wired or wireless communication with the display screen 16 to send messages to the display screen 16 to be displayed.

Figure 2:
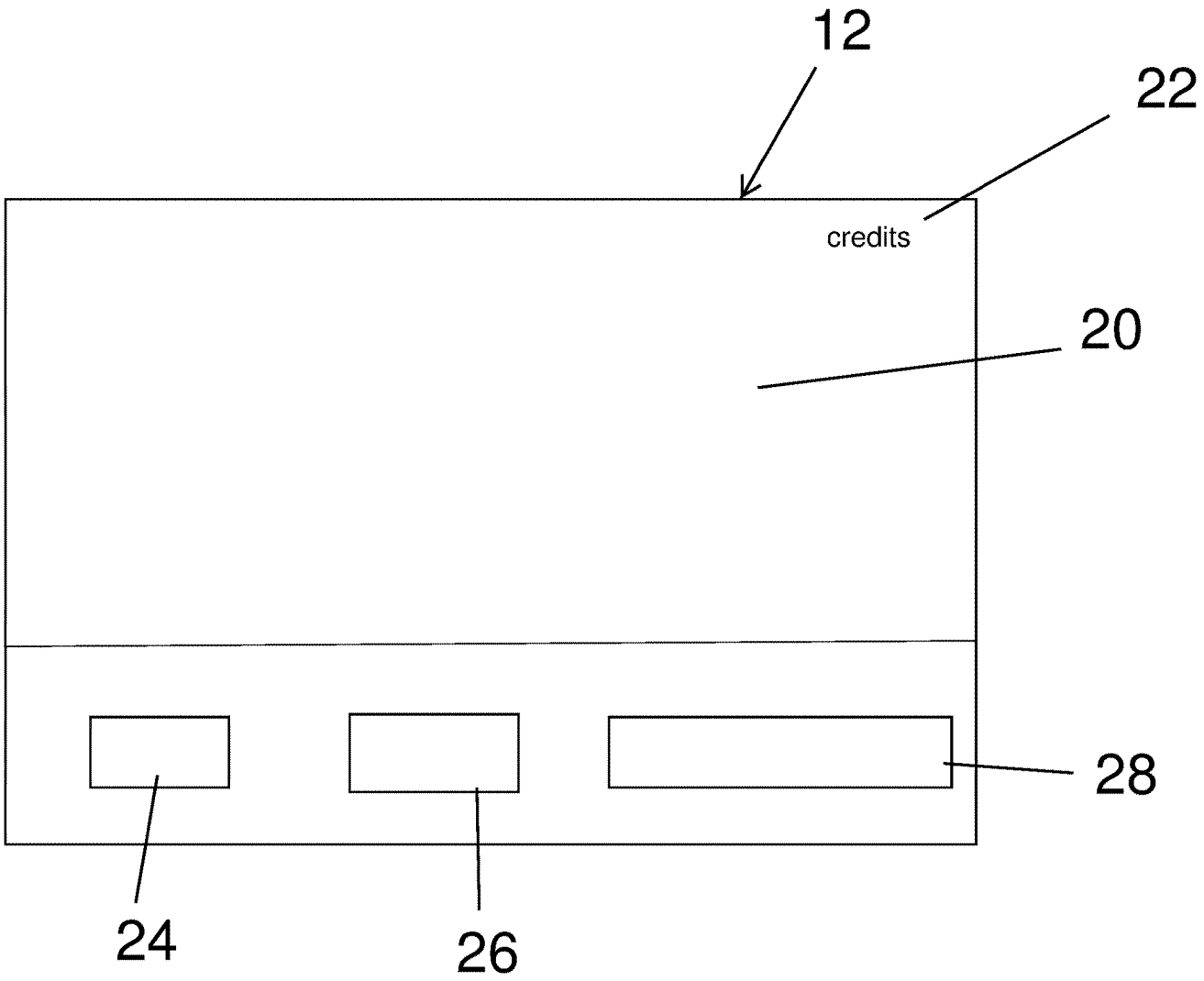
FIG. 2 is a schematic depiction of an example EGM described herein.

Referring to FIG. 2, an example of one of the EGMs 12 is illustrated. The other EGMs can have a similar construction. The EGM 12 can be located in a casino or in other locations that permit gambling. The construction and operation of the EGM 12 is conventional including a display screen 20 that displays the game components (for example, reels in the case of an electronic slot machine or cards in the case of electronic poker), and a section 22 on the screen 20 that displays the number of credits available and/or a monetary value. The EGM 12 would also include various conventional "buttons" (not illustrated) for selecting the amount to be wagered, initiating game operation, cashing out, and the like. The various "buttons" can be mechanical buttons disposed on the machine, or virtual buttons displayed on the display screen 20 (for example in a picture-in-picture display) which functions as a touchscreen.

The EGM 12 also includes a token reader 24 that reads a token that is issued to a player that signs up for a casino rewards program. In conventional casino rewards programs, the token is typically a plastic card that bears a magnetic stripe on which data is stored that is specific to the player such as a unique identification code assigned to the player, and the token reader 24 is a magnetic stripe card reader that can read the data on the magnetic stripe. However, other forms of tokens and token readers can be used. For example, the assigned token can include a card or other token element with a contact or contactless integrated circuit chip and the token reader 24 can read the chip, the token reader 24 can be a biometric reader that reads the player's fingerprint, performs an iris scan, or performs facial recognition with the read data being compared to biometric data of the player previously stored, or the token reader 24 can be a near field radio frequency device that performs near field reading of a player token such as an assigned token element or reading of the player's smart device which functions as the token.

The EGM 12 can also be provided with an optional data entry device 26 that permits entry of data by the player. The data entry device 26 can take any form that permits entry of data by the player into the EGM 12. In one embodiment, the data entry device 26 can be a dedicated mechanical alphanumeric keypad mounted on the EGM 12. In another embodiment, the data entry device 26 can be part of a touchscreen display 28 mounted on the EGM 12 where the data entry device 26 takes the form of virtual buttons on the touchscreen display 28. In still another embodiment, the data entry device 26 can be part of the display screen 20 of the EGM 12 where the data entry device 26 takes the form of virtual buttons displayed on the display screen 20 (such as in a picture-in-picture display). In another embodiment, data entry by the player could take place using the player's smart device which may be in direct communication with the EGM 12 or where the player uses their smart device to inform the control system 14 which EGM 12 the player wishes to play, thereby eliminating the need for the data entry device 26. In another embodiment, the data entry device 26 can be a device that is separate from the EGM 12, for example the data entry device 26 could be a device that is mounted adjacent to but is mechanically separate from, the EGM 12.

The token reader 24 and the optional data entry device 26 permit registration of the player with the EGM 12. A player that is part of the casino rewards program that wishes to have his game play tracked selects the EGM 12 he wishes to play. The player then uses the token reader 24 to read their assigned token, for example by inserting an assigned magnetic stripe card into a magnetic stripe card reader. In addition, in some embodiments where financial transactions may occur or where more secure recognition of the player may be desired, the player may also be required to enter their assigned passcode using the data entry device 26. Information derived from the assigned token and if included the entered passcode are transmitted to the control system 14 which verifies that the data matches data on record. Assuming there is a match, the control system 14 can then keep track of the player's game play on the EGM 12. The EGM 12 may also include a bill acceptor permitting insertion of paper money, a coin slot to accept insertion of coins, and a credit card reader.

The use of assigned tokens, token readers, passcodes and data entry devices to register players with specific EGMs is conventional and well known in the art.

The control system 14 is of generally conventional construction and operation except for its implementation of the social distancing techniques described herein. The control system 14 is typically controlled and operated by the casino or other entity that controls operation of the EGMs 12. However, the control system 14 and the EGMs 12 may be owned by separate entities. Many examples of control systems 14 that can be used are known in the art. One example of a suitable control system that can be used is the CasinoTrac™ casino management system available from Table Trac of Minnetonka, Minn. The control system 14 can be located in the same facility as the EGMs 12, or the control system 14 can be located in a facility that is separate and remote from the EGMs 12.

One function of the control system 14 is to track gaming play of game players on the EGMs 12 as part of the casino rewards program, and maintain an ongoing, live updating of the player's rewards program account based on the player's game play. In addition, if the player has funds in an account, the control system 14 can credit some or all of the funds to the EGM 12 based on a request submitted by the player. In addition, the control system 14 can credit remaining or accumulated credits or winnings from the EGM 12 to the player's account. The control system 14 can also transmit content, such as promotional offers, advertisements, incentives and reward offers, to the EGM 12 and/or to the players smart device.

Figure 3:
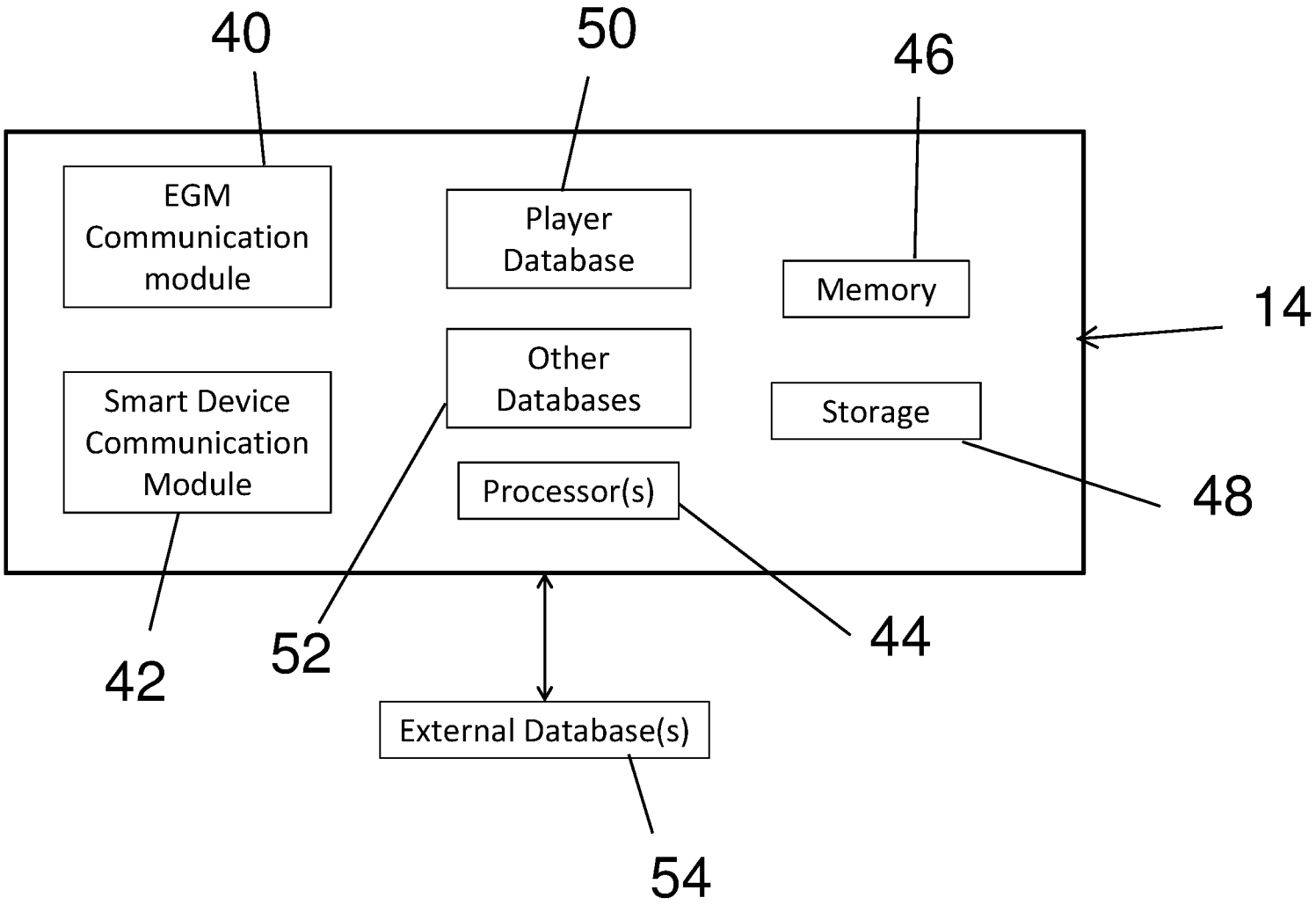
FIG. 3 illustrates an example of a control system that is part of the system of FIG. 1.

Referring to FIGS. 1 and 3, the control system 14 can include elements or be in communication with elements that are suitable for performing the functions of the control system 14 described herein. For example, the control system 14 can include, but is not limited to, a game communication module or means 40 for communications with the EGMs 12, a smart device communication module or means 42 for communications with player smart devices, one or more processors 44 or a single processor having multiple processing cores, memory 46 and/or storage 48, a player database 50 containing information on the players in the casino rewards program, and one or more other databases 52. The control system 14 may also be in communication with one or more external databases 54. The processor 44 can be a single processor, multiple processors, or a single processor having multiple processing cores. The processor 44 can be a single-threaded processor or a multi-threaded processor.

The memory 46 is generally representative of a random access memory such as, but not limited to, Static Random Access Memory (SRAM), Dynamic Random Access Memory (DRAM), or Flash. In some embodiments, at least a portion of the memory can be virtual memory. The storage 48 is generally representative of a non-volatile memory such as, but not limited to, a hard disk drive, a solid state device, removable memory cards, optical storage, flash memory devices, network attached storage (NAS), or connections to storage area network (SAN) devices, or other similar devices that may store non-volatile data. In some embodiments, the storage 48 can include storage that is external to the control system 14, such as in cloud storage.

Figure 4:
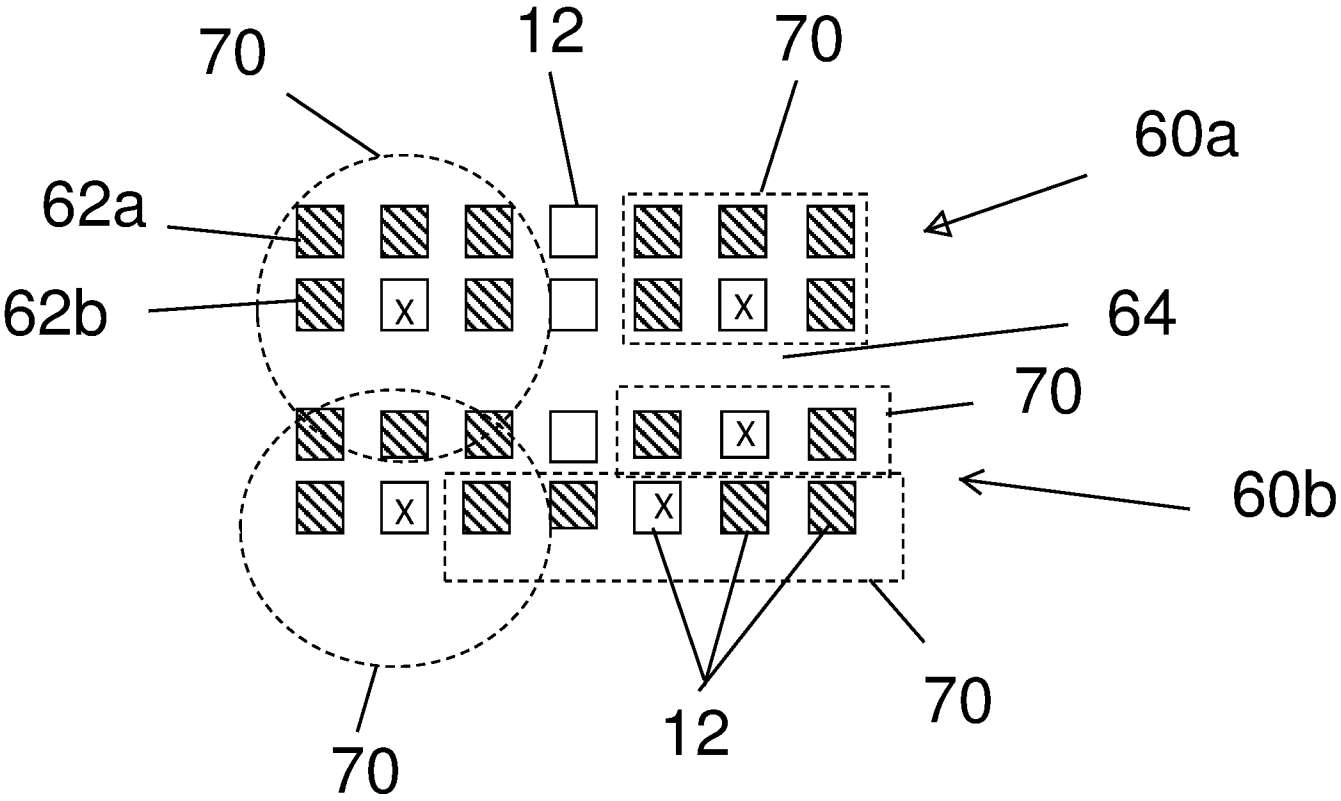
FIG. 4 illustrates examples of deactivation zones among EGMs.

FIG. 4 illustrates an example of a plurality of the EGMs 12 as they may be arranged in a casino or other establishment. In this example, the EGMs 12 are illustrated as being arranged in two banks 60*a*, 60*b*, each bank 60*a*, 60*b* including two rows 62*a*, 62*b* of EGMs 12 arranged back-to-back, with a walkway 64 between the banks 60*a*, 60*b*. Other layouts and arrangements of the EGMs are possible.

A person walks up to a particular EGM 12 that he/she wants to play. For example, in FIG. 4, "X" marks an EGM 12 that a person wants to play or is playing. It is assumed that the EGM 12 is active and available for game play. The player causes a triggering event at the EGM 12 to take place which causes the EGM 12 to send an electronic notice signal to be sent to the control system 14. The triggering event can be any event that can be used to establish that the player wants to game play on the EGM 12. Examples of triggering events incudes, but are not limited to, inserting a player card into the token reader 24 (i.e. a card reader) of the EGM 12, insertion of money into the EGM 12, insertion of a ticket into a ticket reader of the EGM 12, insertion of a credit card into a credit card reader of the EGM 12, or via a selection made on the player's mobile device via an application on the mobile device.

The control system 14 receives the electronic notice signal and in response, the control system 14 automatically temporarily deactivates other EGMs 12 that are within a first deactivation zone 70 adjacent to the EGM 12 being played. The deactivation zone 70 is a zone around the EGM 12 to be played that is intended to keep other persons away from the EGM 12 to be played a sufficient distance to satisfy a desired social distance spacing by temporarily deactivating the other EGMs 12 that are within the zone 70. The social distance spacing of the zone 70 can be chosen by the casino or other establishment, the spacing can be based upon recommendations of local, state, or federal governmental authorities, or the spacing can be based upon recommendations of an authority that governs operations of the casino or other establishment. In some embodiments, the spacing may be selected by the player or the casino, for example by sending a spacing request to the control system 14. The zone 70 can be regular shaped or irregular shaped. In some embodiments, some of the zones 70 within the same casino can have different shapes and/or sizes than other zones 70. The zones may also be predefined zones, with each EGM having a predefined associated zone based on a zone map that may be created by the casino. In addition, the casino can enable activation of multiple adjacent EGMs for simultaneous play by a single player.

In the example illustrated in FIG. 4, "X" indicates EGMs 12 to be played or being played by players, with the associated deactivation zones 70 indicated in dashed lines adjacent to each EGM 12 to be played. In this example, two of the zones 70 are indicated as being circular, and additional zones 70 are indicated as being rectangular. The EGMs 12 falling within each zone 70 and that are deactivated and therefore temporarily unavailable for game play are indicated with the diagonal lines. Deactivating an EGM may also be referred to as the EGM being out of service. In an example version of this state, the lights and screen of the EGM can still be powered up and appear normal. The screen may display a message indicating the EGM is "Out of Service". The bill acceptor and coin slot would be disabled and will not accept tickets, bills or coins. Any player card activity on the deactivated EGM will be ignored. In other embodiments, the deactivated EGMs may be powered down with no power to the lights or the display screen. As depicted in FIG. 4, the deactivation zones 70 may overlap one another as long as the EGM 12 to be played does not fall within another deactivation zone (i.e. the EGM 12 to be played is spaced far enough from another EGM 12 being played to satisfy the desired social distancing).

To maximize use of the EGMs 12 throughout the casino, the control system 14, upon receiving the electronic notice signal from the game play triggering event, may request that the person initiating the game play request move over 1 or 2 EGMs in the row to maximize the number of EGMs 12 being played.

In some embodiments, the control system 14 can send a message to be displayed on the display screen(s) 16 (FIG. 1) indicating EGMs 12 that are currently available for game play. The display screen(s) 16 can be arranged at the entrance of the casino and/or throughout the casino to advise patrons the locations where EGMs 12 are available for game play. In addition, in some embodiments, a patron may be provided the ability to request a reservation of a particular EGM 12 or reserve an EGM in a particular bank of EGMs. The reservation can be made via a casino employee or made via an application on the patrons mobile device.

As long as the player maintains game play, the deactivation zone 70 is maintained around the EGM 12 being played. At cessation of game play on the EGM 12, the control system 14 automatically reactivates one or more of the other EGMs 12 that were previously deactivated within the deactivation zone 70. Cessation of game play on the EGM 12 can be indicated in any manner that indicates that the player is done with game play on the EGM 12. Examples of game play cessation indicators include, but are not limited to, the player cashing out (for example, adding credits to their player account or printing out a cash receipt) and not adding credits or reinserting credits within a cessation time period, the player losing all available or playable credits and not obtaining additional credits within a cessation time period, the player removes their player card from the card reader, by a notice provided by the player via an application on the player's smart device, and the like. Instead of immediately reactivating the other EGMs 12, the deactivated EGMs can remain deactivated until the cleaning described below has been completed.

Optionally, the control system 14 may deactivate the EGM 12 at which game play has just ceased. The display of the EGM 12 may be caused to display a message indicating that the EGM 12 needs cleaning.

Cleaning personnel can then be directed by the control system 14 to the deactivated EGM 12 where game play was just completed. The cleaning personnel can then clean the deactivated EGM 12 (and if desired, immediately adjacent EGMs). Once the EGM 12 is cleaned, a signal can be sent to the control system 14 indicating that the EGM 12 has been cleaned. The control system 14 can then activate the EGM making it available for additional game play. The signal to the control system 14 can be sent by the cleaning personnel, for example by requiring the cleaning personnel to log in to the EGM 12, swiping a card of the cleaning personnel, or by the cleaning personnel otherwise notifying the control system 14 that the EGM 12 has been cleaned.

Figure 5B:
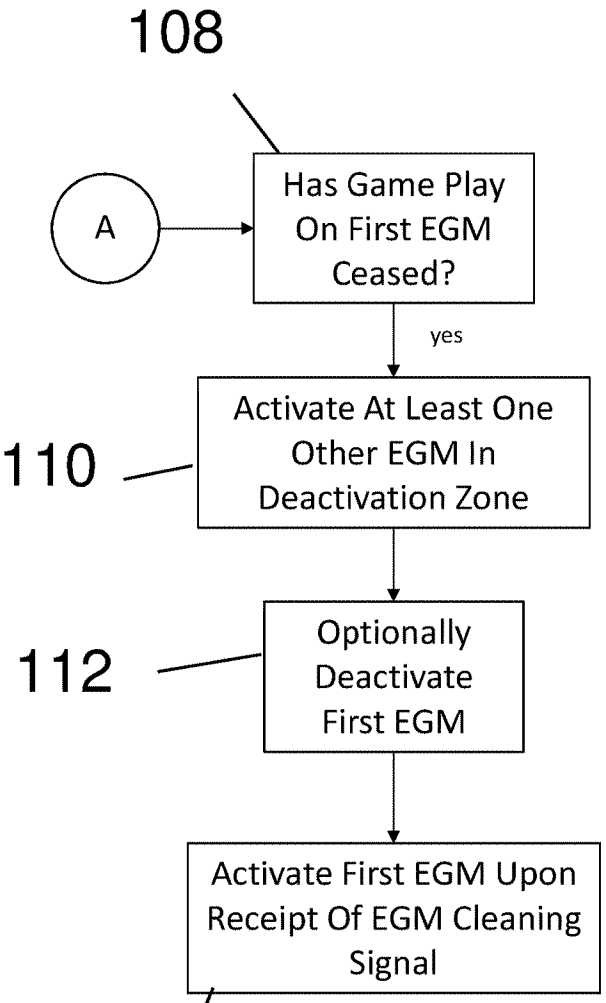
FIGS. 5A and 5B illustrate methods described herein.
Figure 5A:
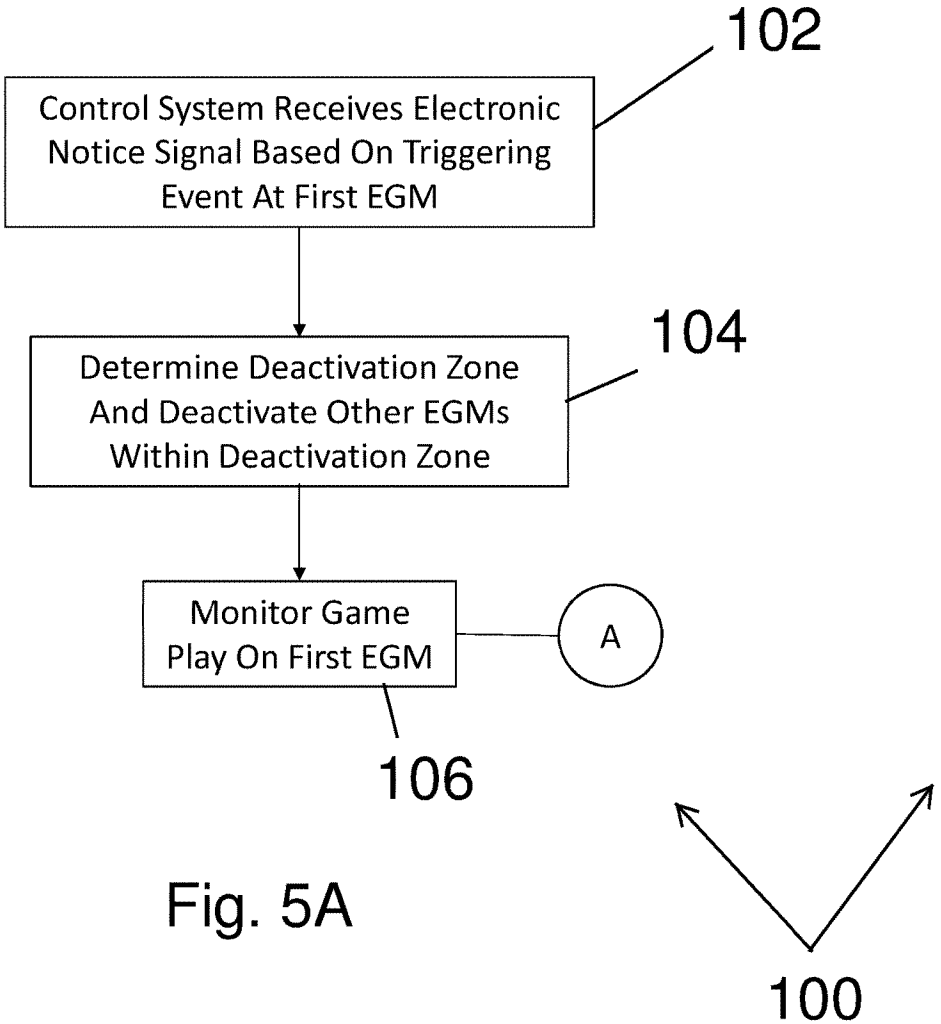

FIGS. 5A and 5B illustrate a method 100 of controlling the EGMs 12 described as herein. At step 102, an electronic notice signal that is generated based upon a game play triggering event at a specific EGM is received by the control system. The control system then determines at step 104 a deactivation zone adjacent to the EGM and send a deactivation signal(s) to deactivate all other EGMs that are within the deactivation zone. At step 106, the control system monitors game play on the EGM. At step 108, if it is determined that game play on the EGM has ceased, the control system at step 110 activates at least one other or all of the previously deactivated EGMs in the deactivation zone. The control system may also optionally deactivate the first EGM at which game play has just ceased at step 112. If the EGM is deactivated, cleaning personnel can be notified by the control system to go clean the now deactivated EGM. Once the deactivated EGM is cleaned, a cleaning signal is sent to the control system at step 114 notifying the control system that the deactivated EGM has been cleaned. The control system then reactivates the EGM making it available for game play (assuming the EGM is not within another deactivation zone).

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of controlling electronic gaming machines in a casino, comprising:

sending electronic notice of a game play triggering event that takes place at a first electronic gaming machine to a control system;

in response to receiving the electronic notice, the control system automatically temporarily deactivating other electronic gaming machines that are within a first deactivation zone adjacent to the first electronic gaming machine.

2. The method of claim 1, wherein the electronic notice is automatically generated by the first electronic gaming machine;

and the control system generates and sends a deactivation signal to each of the other electronic gaming machines that temporarily deactivate the other electronic gaming machines.

3. The method of claim 1, wherein the game play triggering event comprises one of the following:

a. insertion of a player card into a card reader of the first electronic gaming machine;

b. insertion of money into the first electronic gaming machine;

c. insertion of a ticket into the first electronic gaming machine;

d. insertion of a credit card into a credit card reader of the first electronic gaming machine; or e. a selection made on a players mobile device via an application on the player's mobile device.

4. The method of claim 1, wherein the first deactivation zone is a predetermined distance from the first electronic gaming machine.

5. The method of claim 1, wherein the first deactivation zone is a predefined zone associated with the first electronic gaming machine.

6. The method of claim 1, wherein the first deactivation zone overlaps a second deactivation zone associated with a second electronic gaming machine.

7. The method of claim 1, further comprising:

at cessation of game play on the first electronic gaming machine, automatically reactivating one or more of the other, previously deactivated electronic gaming machines associated with the first deactivation zone.

8. The method of claim 7, further comprising automatically temporarily deactivating the first electronic gaming machine at cessation of game play on the first electronic gaming machine.

9. The method of claim 8, comprising permitting automatic reactivation of the first electronic gaming machine after the first electronic gaming machine is indicated as being cleaned.

10. A method of controlling electronic gaming machines in a casino, the electronic gaming machines are in electronic communication with a control system, the method comprising:

generating an electronic notice signal upon a game play triggering event that takes place at a first one of the electronic gaming machines;

sending the electronic notice signal to the control system;

in response to receiving the electronic notice signal:

the control system determining a first deactivation zone adjacent to the first electronic gaming machine, and the control system generates and sends a deactivation signal to electronic gaming machines that are within the first deactivation zone other than the first electronic gaming machine to temporarily deactivate the other electronic gaming machines within the first deactivation zone.

11. The method of claim 10, wherein the electronic notice is automatically generated by the first electronic gaming machine, and the game play triggering event comprises one of the following:

a. insertion of a player card into a card reader of the first electronic gaming machine;

b. insertion of money into the first electronic gaming machine;

c. insertion of a ticket into the first electronic gaming machine;

d. insertion of a credit card into a credit card reader of the first electronic gaming machine; or e. a selection made on a players mobile device via an application on the player's mobile device.

12. The method of claim 10, wherein the first deactivation zone is a predetermined distance from the first electronic gaming machine.

13. The method of claim 10, wherein the first deactivation zone is a predefined zone associated with the first electronic gaming machine.

14. The method of claim 10, wherein the first deactivation zone overlaps a second deactivation zone associated with a second electronic gaming machine.

15. The method of claim 10, further comprising:

at cessation of game play on the first electronic gaming machine, the control system automatically reactivates one or more of the other, previously deactivated electronic gaming machines within the first deactivation zone.

16. The method of claim 15, further comprising automatically temporarily deactivating the first electronic gaming machine at cessation of game play on the first electronic gaming machine.

17. The method of claim 16, wherein the control system permits reactivation of the first electronic gaming machine upon receiving a signal that the first electronic gaming machine has been cleaned.

18. At least one non-transitory computer-readable storage medium that includes instructions stored thereon that, responsive to being executed with processor circuitry of a computer control system that includes the at least one non-transitory computer-readable storage medium, causes the computer control system to implement a method of controlling electronic gaming machines in a casino that are in communication with the computer control system, the method including:

receiving an electronic notice of a game play triggering event that takes place at a first one of the electronic gaming machines;

in response to receiving the electronic notice:

determining a first deactivation zone adjacent to the first electronic gaming machine, and generating and sending a deactivation signal to electronic gaming machines that are within the first deactivation zone other than the first electronic gaming machine to temporarily deactivate the other electronic gaming machines within the first deactivation zone.

19. The at least one non-transitory computer-readable storage medium of claim 18, wherein the electronic notice signal is received from the first electronic gaming machine.

20. The at least one non-transitory computer-readable storage medium of claim 18, wherein the first deactivation zone is a predetermined distance from the first electronic gaming machine.

21. The method of claim 18, wherein the first deactivation zone is a predefined zone associated with the first electronic gaming machine.

22. The at least one non-transitory computer-readable storage medium of claim 18, wherein the first deactivation zone overlaps a second deactivation zone associated with a second electronic gaming machine.

23. The at least one non-transitory computer-readable storage medium of claim 18, wherein the method further includes:

at cessation of game play on the first electronic gaming machine, the control system automatically reactivates one or more of the other, previously deactivated electronic gaming machines within the first deactivation zone.

24. The method of claim 23, further comprising automatically temporarily deactivating the first electronic gaming machine at cessation of game play on the first electronic gaming machine.

25. The at least one non-transitory computer-readable storage medium claim 24, wherein the control system permits reactivation of the first electronic gaming machine upon receiving a signal that the first electronic gaming machine has been cleaned.

* * * * *